US009498929B2

(12) United States Patent
Brooks

(10) Patent No.: US 9,498,929 B2
(45) Date of Patent: Nov. 22, 2016

(54) BAG-IN-BOX ASSEMBLY APPARATUS AND METHOD OF COUPLING A BAG AND A BOX TO FORM A BAG-IN-BOX ASSEMBLY

(71) Applicant: Scholle Corporation, Irvine, CA (US)

(72) Inventor: John Brooks, Leabrook (AU)

(73) Assignee: Scholle IPN Corporation, Northlake, IL (US)

( * ) Notice: Subject to any disclaimer, the term of this patent is extended or adjusted under 35 U.S.C. 154(b) by 514 days.

(21) Appl. No.: 14/060,890

(22) Filed: Oct. 23, 2013

(65) Prior Publication Data

US 2014/0121089 A1 May 1, 2014

Related U.S. Application Data

(60) Provisional application No. 61/717,253, filed on Oct. 23, 2012.

(51) Int. Cl.

| | |
|---|---|
| ***B31B 1/64*** | (2006.01) |
| ***B31B 1/00*** | (2006.01) |
| ***B65D 77/06*** | (2006.01) |

(52) U.S. Cl.

CPC . *B31B 1/64* (2013.01); *B31B 1/00* (2013.01); *B65D 77/065* (2013.01); *B31B 2201/29* (2013.01); *B31B 2217/0061* (2013.01)

(58) Field of Classification Search

None

See application file for complete search history.

(56) References Cited

U.S. PATENT DOCUMENTS

| | | | | |
|---|---|---|---|---|
| 4,430,068 | A * | 2/1984 | vom Hofe | B29C 49/24 264/516 |
| 4,505,694 | A * | 3/1985 | Okushita | B31B 7/00 493/101 |
| 4,601,410 | A * | 7/1986 | Bond | B65B 61/186 222/105 |
| 5,277,015 | A * | 1/1994 | Brown | B05B 11/048 222/105 |
| 2008/0041018 | A1 | 2/2008 | Stephenson | |
| 2008/0267538 | A1* | 10/2008 | Stephenson | B65D 25/16 383/33 |
| 2011/0024464 | A1* | 2/2011 | Jaouen | A45D 27/10 222/236 |
| 2011/0253774 | A1* | 10/2011 | Hill | B65D 5/46112 229/117.3 |

FOREIGN PATENT DOCUMENTS

| | | | |
|---|---|---|---|
| WO | 2005/000705 | A1 | 1/2005 |
| WO | 2007/057677 | A1 | 5/2007 |

* cited by examiner

*Primary Examiner* — Gloria R Weeks
*Assistant Examiner* — Tanzim Imam
(74) *Attorney, Agent, or Firm* — The Watson I.P. Group, PLC; Jovan N. Jovanovic; Vladan M. Vasiljevic

(57) ABSTRACT

A bag-in-box assembly apparatus comprising a frame, an insertion assembly and assembly urging arms. The bag-in-box assembly apparatus is configured for use in association with a bag-in-box package having a box with an opening and a bag having a spout. A collar is coupled to the spout of the bag and the also interfaces with the opening of the box. The assembly apparatus is utilized to couple the collar to the bag, inserting the bag into the box and coupling the collar to the box.

13 Claims, 11 Drawing Sheets

BAG-IN-BOX ASSEMBLY APPARATUS AND METHOD OF COUPLING A BAG AND A BOX TO FORM A BAG-IN-BOX ASSEMBLY

CROSS-REFERENCE TO RELATED APPLICATION

The present application claims priority from U.S. Provisional Patent Application Ser. No. 61/717,253 filed Oct. 23, 2012, entitled Bag-In-Box Assembly Apparatus And Method of Coupling a Bag and a Box to Form a Bag-In-Box Assembly, the entire specification of which is hereby incorporated by reference in its entirety.

BACKGROUND OF THE DISCLOSURE

1. Field of the Disclosure

The disclosure relates in general to bag-in-box packaging methods and equipment, and more particularly, to a bag-in-box assembly apparatus and a method of coupling a bag and a box to form a bag-in-box assembly.

2. Background Art

The use of bag-in-box packaging is well known in the art. One challenge has been to provide bag-in-box packaging that has a relatively easily locatable tap, or a tap that is accessible without having to reach into the box to retrieve. A number of such bag-in-box packages have been devised and developed. These packages are utilized for any number of different flowable materials, such as syrups, wine and other beverages, chemicals, oils, and the like.

An entire class of such bag in box packages relies upon the placement of a bag and dispensing tap within the outer box. The outer box has a frangible or tearable portion which can be removed to expose the tap. Once the tap has been located, the user can generally withdraw the tap from the box and use the tap to dispense the contents of the bag. In some embodiments, the tap can be coupled to the box such that it is in a dispensing position.

While the aforementioned bag in box packages have been commercially successful, they are often not suitable for some applications where a fixed outside tap is desired. In those types of packages, the tap or dispensing element is already coupled to the outside of the box and in a dispense ready configuration. Among other advantages, the user can quickly and easily begin using the container. Additionally, with the tap being located on the outside of the box, the bag in box can be filled in a fully erected configuration and often on relative standard filling equipment. Among other solutions, certain such bag in box packages are disclosed in of U.S. Pat. App. Pub. No. 2006/0180643 published to Stephenson; U.S. Pat. App. Pub. No. 2008/0041018 published to Stephenson; U.S. Pat. App. Pub. No. 2008/0267538 published to Stephenson, and WO 2007/057677 published to Stephenson all of which are incorporated in their entirety. These references all contemplate a bag that is coupled to a collar which is then coupled to the outer box. The collar provides a recessed region for the positioning of the tap, cap or dispensing element so that it is easily accessible.

Problematically, while such containers have been developed, it has proven difficult to have such containers assembled and filled. One problem is associated with the insertion of the bag within the box and the locating of the spout of the bag (to which the tap is coupled) relative to the box in fixed engagement therewith. The aforementioned patent publications disclose different manners of achieving the assembly. One particular solution has been to flat assemble the package with the bag engaged to the collar and the collar engaged to the box. The box is initially flat and articulated with these components in place. Such a solution has some drawbacks, one of which is that bags are compromised as they are pinched during the articulation of the box from a flat pack.

Another solution has been to manually insert the bag into the fully assembled box prior to snapping the collar onto the outer box. Yet another solution has been the creation of a cartridge. The cartridge comprises a bag which is coupled to the collar. The bag is folded under the footprint of the collar and then maintained in such an orientation by a frangible element such as a paper retainer, or a piece of low strength adhesive tape. Once the cartridge is coupled to the box, a puff of air at pressure breaks the frangible element allowing the bag to expand into the cavity. This solution has also revealed some drawbacks associated with the difficulty of folding the bags into the desired shape and the development of cracks or fractures in the bags when folded into the desired shape.

It is an object of the present invention to provide for an apparatus that facilitates the assembly of bag-in-box packaging.

It is another object of the present invention to provide for the assembly of bag-in-box packaging.

It is another object of the invention to improve bag-in-box handling and processing.

These objects as well as other objects of the present invention will become apparent in light of the present specification, claims, and drawings.

SUMMARY OF THE INVENTION

The disclosure is directed, in one aspect, to a method of coupling a bag to a box for a bag-in-box package comprising the steps of: providing a box having a plurality of panels defining a cavity, and an opening providing ingress into the cavity; providing a bag having a plurality of panels heat sealed together to form a substantially fluid-tight cavity, a spout coupled thereto providing ingress into the cavity, and a collar coupled to the spout, the collar attachable to the opening of the box; providing an insertion assembly having a probe terminating at a distal end; extending the distal end of the probe into the bag through the spout, while substantially retaining the spout so as to elongate the bag along the probe; inserting the probe with the bag extended therearound into the cavity of the box; and removing the probe from within the cavity of the box while maintaining the bag within the box.

In a preferred embodiment, the method further comprises the step of evacuating air from within the bag to orient the bag in shape mating form with the probe prior to the step of inserting.

In another embodiment, the method further comprises the step of attaching the collar to the opening of the box prior to the step of removing the probe from within the cavity of the box.

In some such embodiments, the method further comprises the step of configuring the bag to preclude pinching of a portion of the bag between the collar and the box prior to the step of attaching.

In another such embodiment, the method further comprises the step of inflating the bag after the step of inserting the probe but prior to the step of attaching the collar.

Preferably, the method further comprises the step of inflating the bag after the step of inserting the probe.

In another preferred embodiment, the probe has a length that can vary with the configuration of the bag.

In another preferred embodiment, the probe includes telescoping components that are outwardly biased relative to each other toward an increasing length.

Preferably, the bag comprises a pillow bag.

In another preferred embodiment, the step of extending the distal end of the probe into the bag through the spout, while substantially retaining the spout so as to elongate the bag along the probe further comprises the steps of providing assembly urging arms; and directing the bag against the assembly urging arms whereby the assembly urging arms direct the bag inwardly toward the probe.

In another preferred embodiment, the step of providing a bag having a plurality of panels heat sealed together to form a substantially fluid-tight cavity, a spout coupled thereto providing ingress into the cavity, and a collar coupled to the spout, the collar attachable to the opening of the box further comprises the steps of providing a bag having a plurality of panels heat sealed together to form a substantially fluid-tight cavity with a spout coupled thereto providing ingress into the cavity; providing a collar that includes an opening configured to accept and retain the spout in engagement; extending the probe into the opening of the collar; retaining the collar in engagement with the probe in an orientation that is spaced apart from the distal end thereof; inserting the probe into the fluid-tight cavity of the bag while substantially retaining the spout; and coupling the collar to the spout through continued insertion of the distal end of the probe into the substantially fluid-tight cavity of the bag.

In another preferred embodiment, the method further comprises the steps of providing a collar pickup station; providing a bag and collar mating station; and providing a collar to box mating station. In such an embodiment, the step of retaining the collar in engagement occur at the collar pickup station, the step of coupling the collar to the spout occur at the bag and collar mating station and the step of inserting the probe within the box occurs at the collar to box mating station.

In another preferred embodiment, the probe is configured to translate between the collar pickup station, the bag and collar mating station and the collar to box mating station.

In another preferred embodiment, the method further comprises the step of configuring the bag to preclude pinching of a portion of the bag between the collar and the box prior to the step of removing.

Preferably, the probe configured for use in the described methods comprise a plurality of shafts, biasing springs, a terminating member, a collet gripping mechanism and a passageway. The plurality of shafts are telescopically coupled together. The biasing springs are configured to outwardly bias plurality of shafts toward an increased length. The terminating member is positioned at a distal end of a lower one of the plurality of shafts. The collet gripping mechanism is positioned on an upper shaft of the plurality of shafts so as to be spaced apart from the terminating member. The passageway extends between the upper shaft at a location beyond the collet gripping mechanism and the terminating member for fluid communication therebetween.

In another preferred embodiment, the plurality of shafts comprises an upper shaft, a lower shaft and a central shaft.

In another preferred embodiment, the terminating member comprises a ball end.

BRIEF DESCRIPTION OF THE DRAWINGS

The disclosure will now be described with reference to the drawings wherein:

FIG. 11 of the drawings schematically depicts the probe being inserted through the collar at the collar pickup station to couple the collar to the probe;

FIG. 12 of the drawings schematically depicts the collar coupled to the probe and the probe being withdrawn from the collar pickup station;

FIG. 13 of the drawings schematically depicts the probe as being moved to the bag and collar mating station with the probe being introduced to the spout of the bag;

FIG. 14 of the drawings schematically depicts the probe passing through the spout of the bag on the bag and collar mating station, with continued insertion of the collar;

FIG. 15 of the drawings schematically depicts the probe directing the bag into the cavity of the bag and collar mating station while coupling the collar to the spout of the bag;

FIG. 16 of the drawings schematically depicts the probe being withdrawn from the cavity of the bag and collar mating station while air is being pulled from within the bag itself making the bag shape matingly engage the probe, and while the assembly urging arms direct the bag toward conformity with the probe;

FIG. 17 of the drawings schematically depicts the continued evacuation of the bag while translating the probe (with bag and collar) to the collar to box mating station;

FIG. 18 of the drawings schematically depicts the directing of the probe (with the bag) into the cavity of the box;

FIG. 19 of the drawings schematically depicts the inflating of the bag when inserted with the cavity of the box;

FIG. 20 of the drawings schematically depicts the insertion of the collar and the mating of the collar to the box after at least a partial inflation of the bag; and FIG. 21 of the drawings schematically depicts the release of the collar by the probe and the removal of the probe from the box.

DETAILED DESCRIPTION OF THE DISCLOSURE

Figure 1:
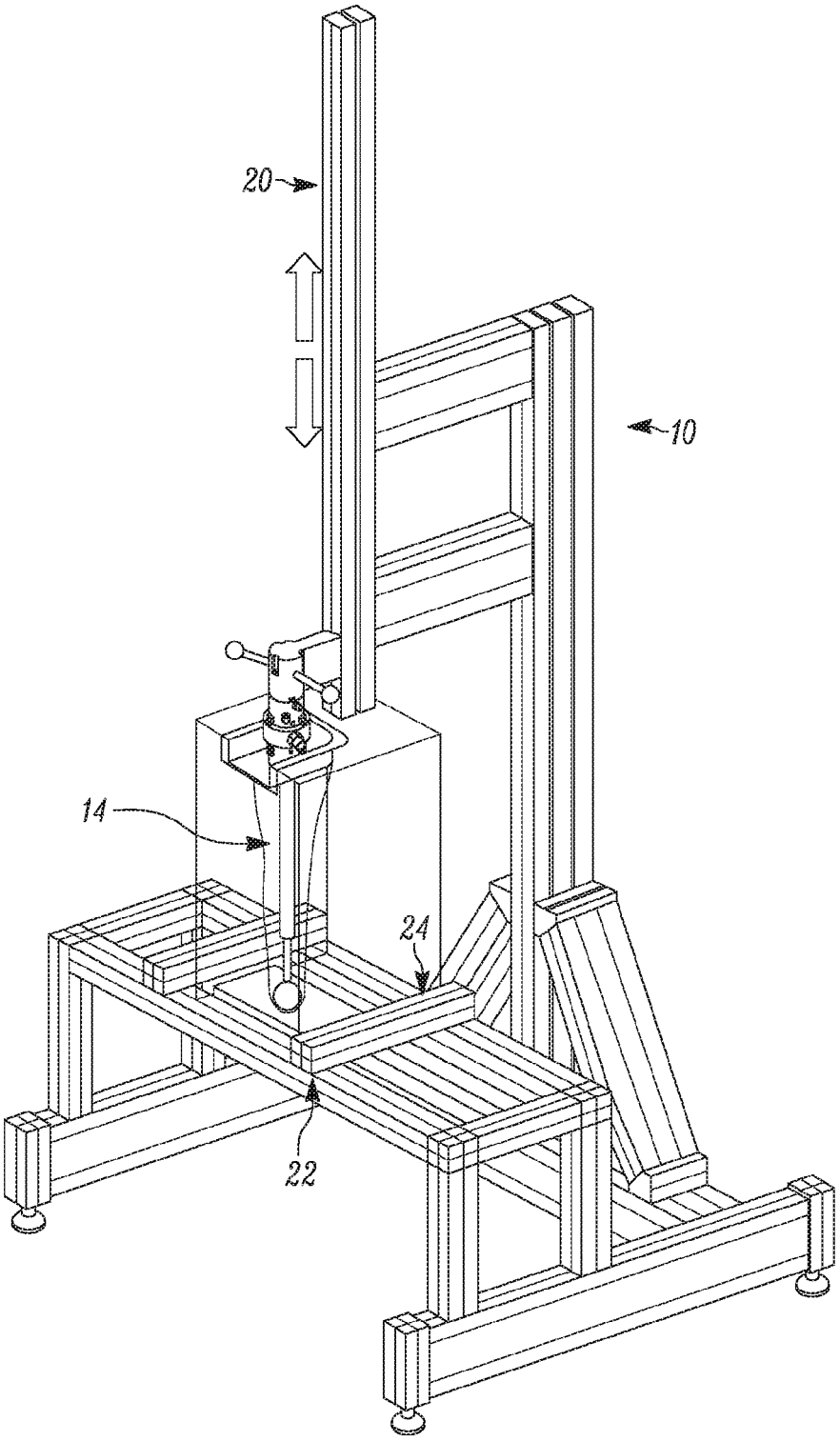
FIG. 1 of the drawings is a perspective view of the bag-in-box assembly apparatus of the present disclosure.
Figure 2:
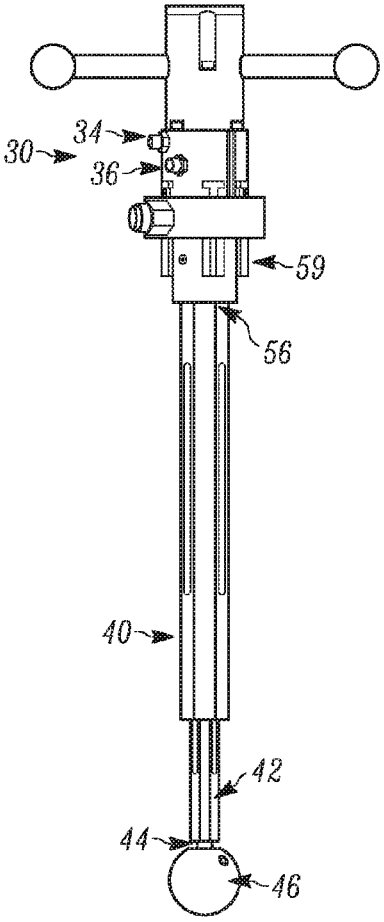
FIG. 2 of the drawings is a side elevational view of the insertion assembly of the present disclosure.
Figure 3:
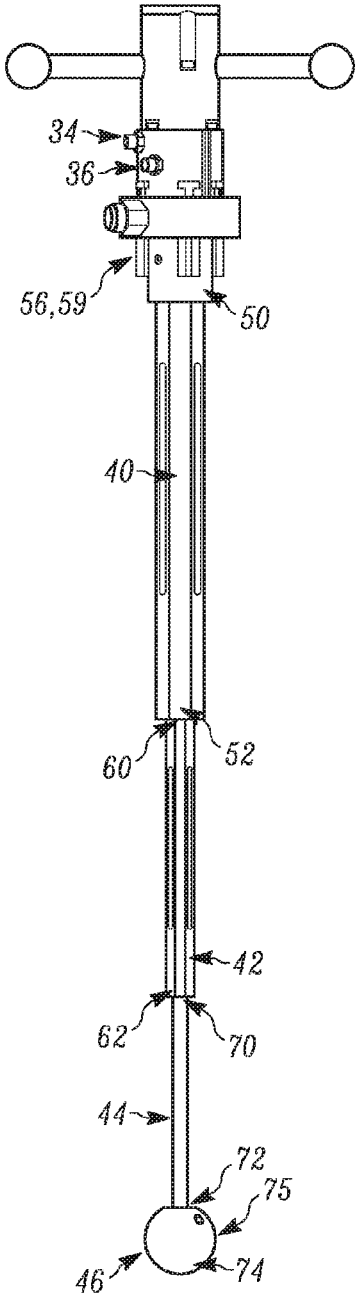
FIG. 3 of the drawings is a side elevational view of the insertion assembly of the present disclosure.
Figure 4:
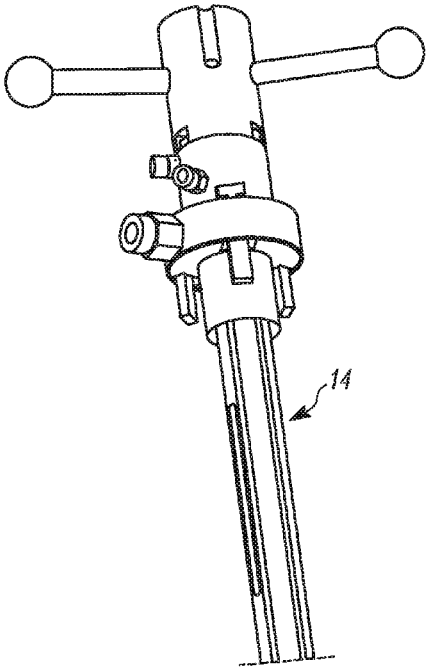
FIG. 4 of the drawings is a partial perspective view of the insertion assembly of the present disclosure.
Figure 6:
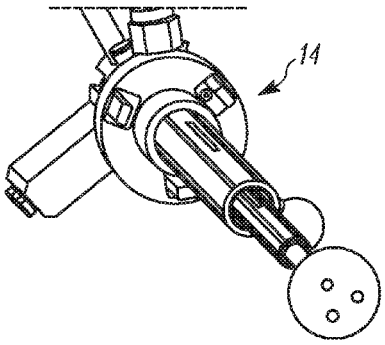
FIG. 6 of the drawings is a partial perspective view of the insertion assembly of the present disclosure.
Figure 5:
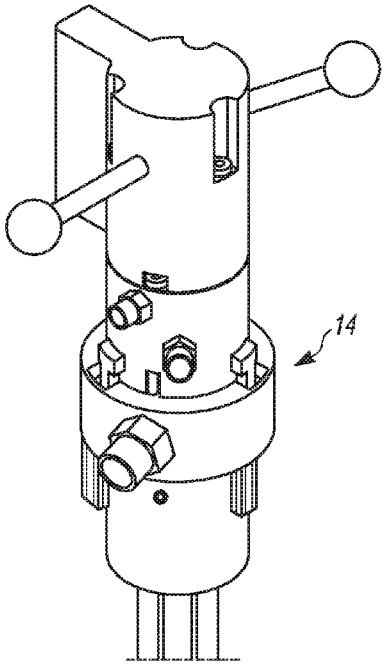
FIG. 5 of the drawings is a partial perspective view of the insertion assembly of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, bag-in-box assembly apparatus is shown generally at 10. The bag-in-box assembly apparatus is well suited in the production and assembly of bag-in-box packages wherein the bag is coupled to a collar and the collar is then coupled to an outer box. Examples of such bag-in-box packages can be seen in that which is disclosed in any one of U.S. Pat. App. Pub. No. 2006/0180643 published to Stephenson; U.S. Pat. App. Pub. No. 2008/0041018 published to Stephenson; U.S. Pat. App. Pub. No. 2008/0267538 published to Stephenson; all of which are incorporated by reference in their entirety. Of course, other configurations are likewise contemplated.

Typically, such packages are utilized for any number of different applications, including foodstuffs (such as edible oil and the like), agricultural pesticides and the like, as well as, wine and other beverages. The disclosure is not limited to any particular product or any particular industry, and the foregoing are to be considered solely exemplary.

Figure 7:
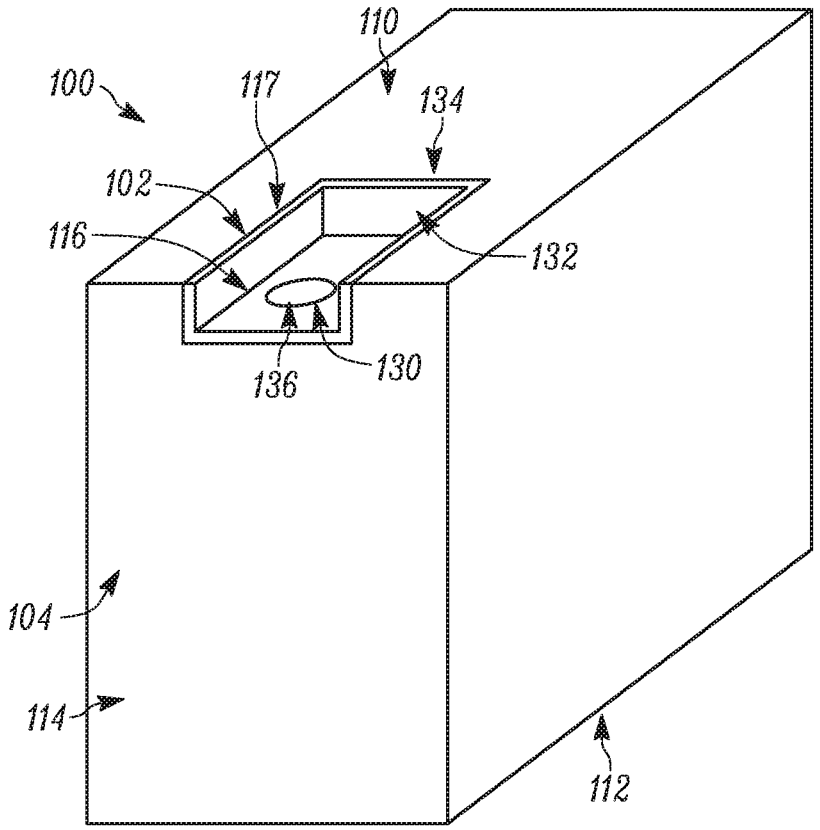
FIG. 7 of the drawings is a perspective view of a bag-in-box container for use in association with the bag-in-box assembly apparatus of the present disclosure.

More specifically, and with reference to FIG. 7, an exemplary bag-in-box package is shown generally at 100. The bag-in-box package includes box 104, collar 102 and bag 106. The bag-in-box packaging generally has a capacity of between five and fifty liters, although other configurations are contemplated, and these are merely for illustrative purposes. The box includes top panel 110, bottom panel 112 and a plurality of side panels, such as side panel 114. The panels together define cavity 116, and opening 117 provides ingress thereto. The opening 117, in the embodiment shown, the opening 117 extends through the top panel 110, and a portion of the same extends through one of the side panels 114. In other embodiments, the opening 117 may extend only through the top panel, and others extend through multiple body panels, such as a plurality of side panels 114 and the top panel. The box generally comprises a single or multiple layer corrugated paperboard material. In other embodiments, the box may comprise a corrugated polymer based material. In still other embodiments, other materials may be utilized.

Figure 8:
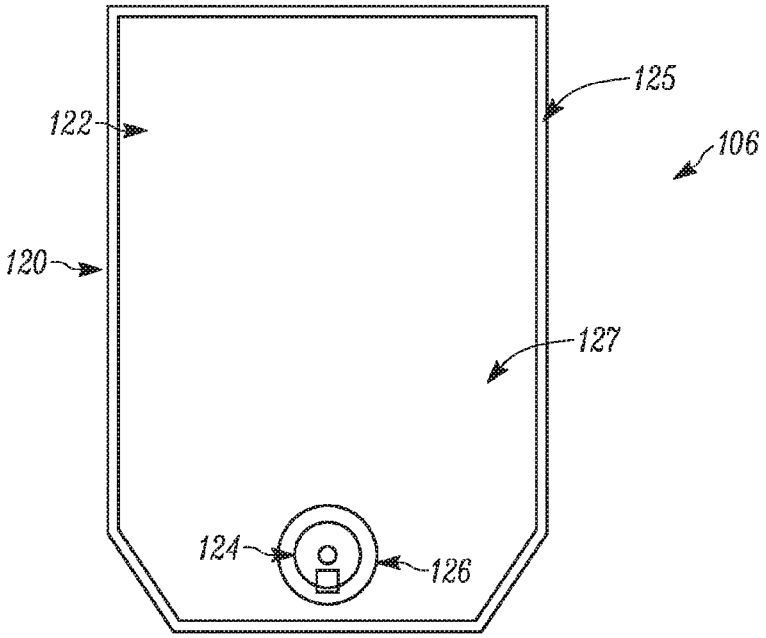
FIG. 8 of the drawings is a top plan view of a bag for use in association with the bag-in-box assembly apparatus of the present disclosure.
Figure 9:
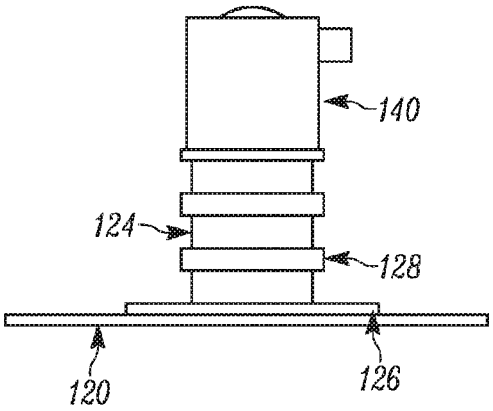
FIG. 9 of the drawings is a partial side elevational view of the bag for use in association with the bag-in-box assembly apparatus of the present disclosure.

The bag 106 is shown generally at FIGS. 8 and 9 as comprising a conventionally known pillow type container having top panel 120, bottom panel 122 which are joined together with an outer perimeter seal 125 to define cavity 127 which is substantially fluid-tight. In the embodiment shown, the top panel and the bottom panel comprise a single ply or a multi-ply laminated or co-extruded polymer film. In the embodiment shown, the corners of the bag proximate the spout are cut off by a diagonal seal, and the opposing corners may be so cut by a diagonal seal. It is believed that such a bag configuration facilitates ease of assembly, in that the corners tend to become trapped between the collar and the opening of the box during insertion, or can snag against the box during insertion. In certain embodiments, a single ply co-extruded material is contemplated for use. Again, the foregoing materials and combinations are generally disclosed as being exemplary with the understanding that there are not to comprise limitations. In other embodiments, other bag configuration may be utilized. For example, bag 106 may comprise a gusseted bag, as well as other bag configurations.

A spout 124 is coupled to the top panel 120 and includes base flange 126. The base flange 126 is sealed to a corresponding opening in the top panel 120 to provide a fluid-tight coupling between the panel and the spout. The spout 124 provides ingress into the cavity, and is preferably positioned close to the seal substantially mid-way between the side edges of the bag. Such a configuration allows for the spout to facilitate proper grasping and retention by the probe in the appropriate desired configuration, and also, such a position precludes the capturing or pinching of the bag proximate the seal between the collar and the opening of the box. The spout may include a plurality of grasping flanges 128 to facilitate the grasping and retention by outside equipment. A tap 140 is likewise shown. The tap 140 may comprise any one of a number of different taps, including, but not limited to the taps shown in U.S. Pat. No. 6,978,981 issued to Roos; U.S. Pat. No. 4,619,377 issued to Roos; U.S. Pat. No. 6,045,119 and U.S. Pat. No. 6,296,157, both issued to Erb as well as the tap shown in U.S. Pat. No. 7,240,811 issued to Roser, the entire disclosures of each of the patents is hereby incorporated by reference in their entirety.

The collar 102 is shown in FIG. 7 comprises base 130, upstanding wall 132, box coupling structure 134 and spout coupling opening 136. The base 130 is substantially planar, while other configurations are contemplated, and defines an outer perimeter. A portion of the outer perimeter includes an upstanding wall extending therefrom, generally, extending substantially perpendicular therefrom. The box coupling structure 134 is positioned at or near the terminating end of the upstanding wall. The box coupling structure 134 is structurally configured to retain the collar 102 to the box 104, about the opening 117 thereof. The spout coupling 136 comprises an opening which is structurally configured to capture and retain the spout 124 of the bag 106 in operable engagement. In certain embodiments, the collar may be integrally formed with the spout 124 of the bag 106. More generally, the components are typically separate components that are coupled together.

Among the different configurations, bag-in-box containers of the type contemplated for use in association with the bag-in-box assembly apparatus of the present disclosure, includes, but is not limited to, that which is disclosed in any one of U.S. Pat. App. Pub. No. 2006/0180643 published to Stephenson; U.S. Pat. App. Pub. No. 2008/0041018 published to Stephenson; U.S. Pat. App. Pub. No. 2008/0267538 published to Stephenson; all of which are incorporated by reference in their entirety. Of course, other configurations are likewise contemplated.

The bag-in-box assembly apparatus 10 is shown in FIG. 1 as comprising frame 12, insertion assembly 14 and assembly urging arms 16. The bag-in-box assembly apparatus is configured for use in association with the bag-in-box structures disclosed above, as well as with other bag-in-box structures. The bag-in-box assembly apparatus 10 is shown as comprising frame 12, insertion assembly 14 and assembly urging arms 16.

The frame 12 comprises a structure which is configured to house the insertion assembly while maintaining and locating the bag and the box for insertion of the bag within the box. Such a frame often comprises a plurality of framework which provides a structure for the overall assembly. The frame 12 includes insertion assembly mount 20 and box handling platform 22. The mount 20 is configured so as to locate the insertion assembly in an orientation above the box handling platform 22, and to facilitate the positioning of the box on the box handling platform, and in particular, top surface 24 of the box handling platform. It will be understood that, depending on the embodiment, the insertion assembly mount can be fixed in its relationship with the insertion assembly mount. In other embodiments, the insertion assembly mount can be configured to translate relative to the box handling platform. In still other embodiments, the box handling platform can be configured to translate relative to the insertion assembly mount. In some embodiments, the assembly apparatus may be configured to be operated manually by a skilled user. In other embodiments, the assembly apparatus may be partially automated or, may be fully automated wherein serial production is facilitated without skilled user intervention.

The insertion assembly is shown in FIGS. 2 through 6 as comprising base 30 and probe 32. The base 30 is coupled to the insertion assembly mount and includes air/vacuum passageway 34. The base 30 provides a framework for the coupling of the probe thereto.

The probe 32 includes upper shaft 40, central shaft 42, lower shaft 44, terminating member 46 and collapsing springs 48. It will be understood that the upper shaft, the central shaft and the lower shaft are telescopically positioned relative to each other such that they can telescopically be extended or collapsed as desired. The upper shaft 40 includes first end 50, second end 52, central opening (not shown) and collet gripping mechanism 56. The second end 52 includes inward flange (not shown) at the end thereof. The assembly further includes openings that extend along the length thereof between the first and second ends thereof. The collet gripping mechanism includes projections 58 which are configured to interface with the upstanding wall of the collar 102 (and are actuated by an air cylinder or the like (i.e., coupled to an air line so as to be able to extend or retract). A plurality of openings extend between the central opening and the outer surface (which are in fluid communication with the air/vacuum line).

The central shaft 42 is shown in FIGS. 2 through 6 as comprising first end 60, second end 62 and central bore (not shown). First end 60 includes stop (not shown) which is configured to interface with inward flange (not shown) so as to preclude the further movement of the central shaft relative to the lower shaft. It will be understood that the central shaft slides within the central opening of the upper shaft, and its outward movement is precluded by the interface of the inward flange and the stop (not shown) working against each other. The central bore (not shown) is in fluid communication with central opening (not shown) and further openings along the length thereof extend into the central bore.

The lower shaft 44 comprises first end 70, second end 72 and central bore (not shown). The lower shaft has a stop (not shown) at the first end thereof which cooperates with inward flange (not shown). The central bore of this shaft is in fluid communication with the central bore and the central opening of the remaining shafts (and openings are positioned along the length of the lower shaft).

Terminating member 46 is shown as comprising ball end 74 which includes openings 75, while other generally convex configurations are contemplated. The openings are in fluid communication with the central bores and the central opening. The terminating member comprises a distal end of the probe, wherein the proximal end of the probe is coupled to the base of the insertion assembly. A plurality of openings are disposed on the terminating member.

Collapsing springs or other biasing members are disposed between the upper shaft, the central shaft and the lower shaft so as to maintain the assemblies in an outwardly biased (or extended) configuration. It will be understood that upward forces from the outside can serve to overcome the biasing force and to telescopically collapse the shafts toward and into a fully collapsed configuration from an articulated configuration.

With reference to FIGS. 10 through 21, the assembly urging arms 16 comprise a plurality of bristles 80 which are positioned so as to extend about an opening, such as opening 82 through which the probe can extend. That is, the first ends 81 are positioned proximate the outer perimeter, and the second ends extend inwardly therefrom.

The assembly of a typical bag in box package will be shown schematically with FIGS. 10 through 21. In each of the Figures, sequentially, a typical installation station is disclosed. The station has a collar pickup station 201, a bag and collar mating station 202 and a collar to box mating station 203. In the schematic shown, the insertion assembly moves relative to the three stations so as to interact with the same. It will be understood that a number of different configurations are contemplated, in other embodiments, the insertion assembly may be stationary, and the different insertion assembly stations can move to the insertion assembly. The disclosure is not limited to either type or combination of types of movement of the different components to and from the insertion assembly; rather, the schematic is to be deemed to be exemplary of the type of configurations contemplated.

Figure 10:
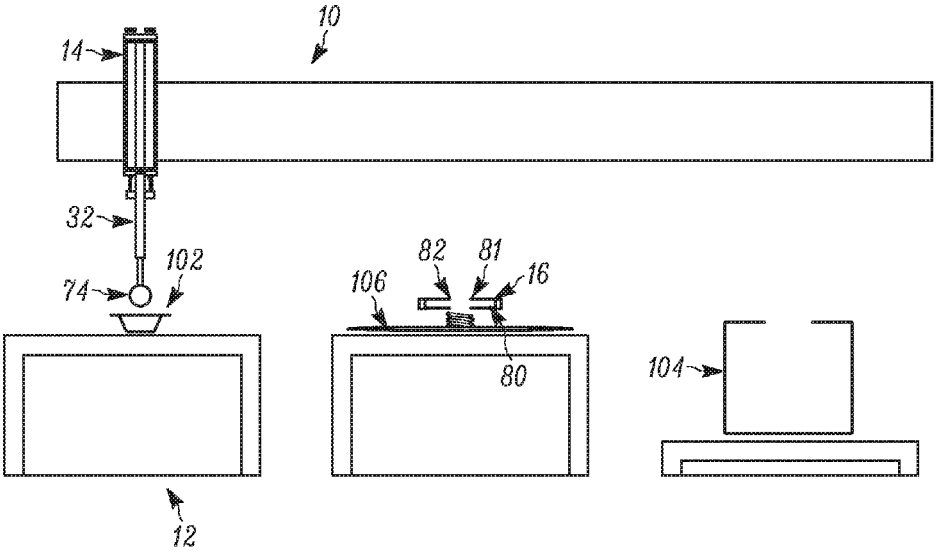
FIGS. 10 through 21 of the drawings comprise sequential schematic representations of a method of coupling a bag and a box of a bag-in-box container utilizing the bag-in-box assembly of the present disclosure, wherein, FIG. 10 of the drawings schematically depicts the collar pickup station, the bag and collar mating station and the collar to box mating station with the probe being movable between these stations, with the collar in position, the bag in position and the box in position within the respective stations, and the probe in position on the collar pickup station.
Figure 11:
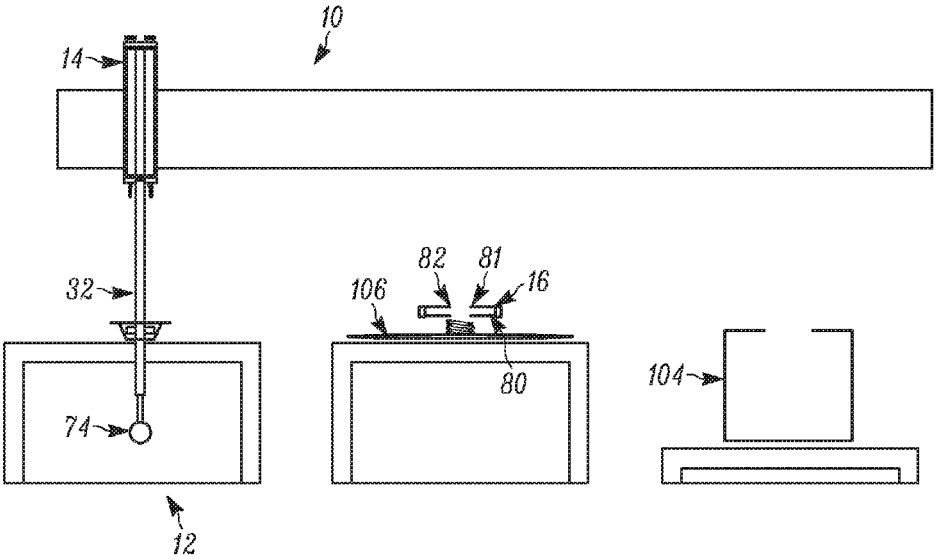

As is shown in FIG. 10, the collar pickup station 201 includes a collar positioned thereon with the opening in the collar corresponding to an opening in the station which can facilitate passage of the probe therethrough. The bag and collar mating station 202 has a bag positioned thereon, again, with the spout of the bag corresponding to an opening within the bag and collar mating station. Finally, an articulated box is positioned on the bag mating station. Of course, in other embodiments, the components of the bag in box package may be provided at the outset or sequentially as needed.

With continued reference to FIG. 10, the probe 32 is positioned over the spout coupling of the collar. With continued reference to FIG. 11, once properly positioned, the probe 32 is directed through the opening of the spout coupling so that the collet gripping mechanism 56 interacts with the upstanding wall of the collar 102 to releasably retain the same. The configuration of the gripping mechanism allows for operative engagement of the spout to the collar even when the collar is retained by the collet gripping mechanism. That is, the features of the collet gripping mechanism are spaced apart from the opening in the collar. In other embodiments, the collar may be preassembled onto the spout. It will be understood that the collet gripping mechanism can be adjustable so as to be able to be adapted to a number of differently sized collets.

Figure 12:
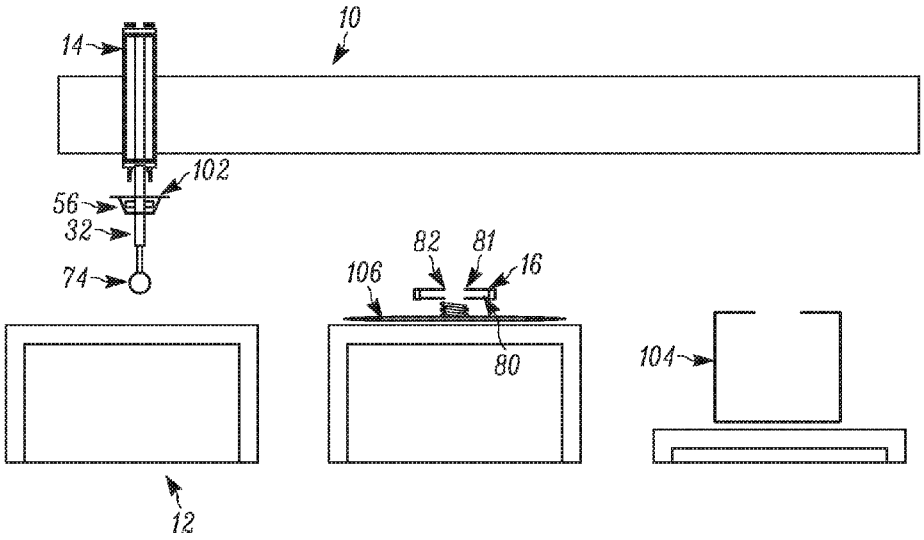
Figure 13:
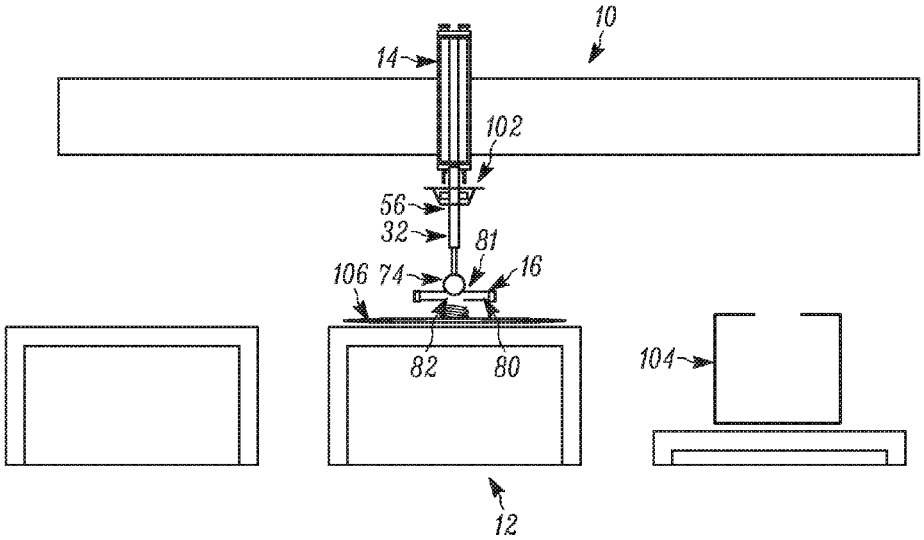

Moving to FIG. 12, once the collar is coupled to the collet gripping mechanism, then the two are moved collectively (i.e., raised in the embodiment shown) so that the probe is clear of the collar pickup station. With reference to FIG. 13, once moved in the desired orientation free from involvement with the collar pickup station, the probe is aligned with the collar mating station 202. In the embodiment shown schematically, the probe is translated so as to be positioned over the collar mating station.

More particularly, the bag is generally in an orientation where the spout is on a table, but the remainder of the bag is draped over an edge. As is shown, the bag may have its corners proximate the spout removed through a seal that trims the corners (for ease of insertion and acclimation to a bag-in-box environment, and to reduce pinching concerns).

Figure 14:
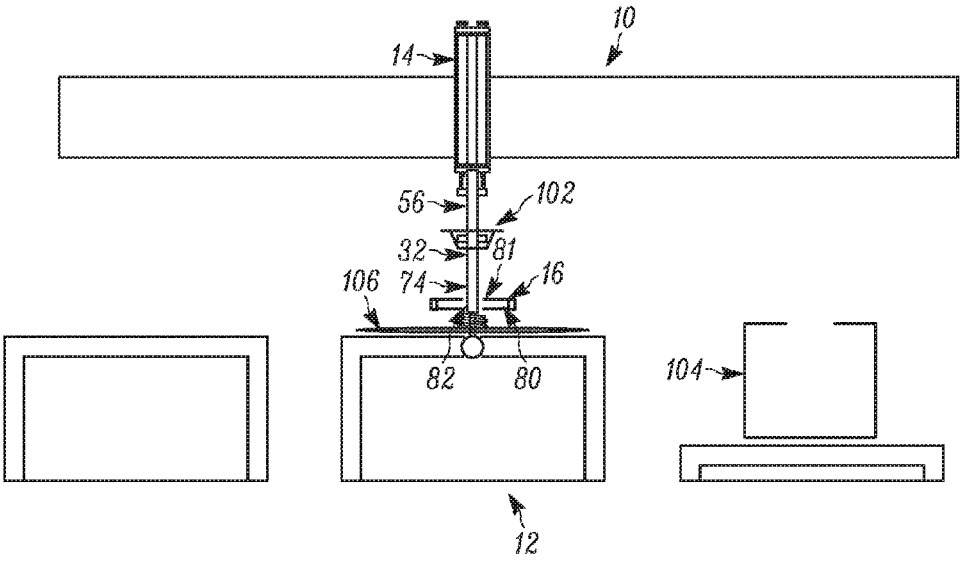

The probe is now inserted through the assembly urging arms 16 (which will become significant during the opposite movement of the probe with the bag coupled thereto), as is shown in FIG. 13. With reference to FIG. 14, as the probe continues in a downward direction, eventually the terminating member of the probe 32 extends through the spout of the bag and into the cavity. The probe passes through the spout and contacts the bag opposite the spout, thereby pushing the bag into the cavity as well. The size of the opening precludes the passage of the spout through the opening into the cavity.

Figure 15:
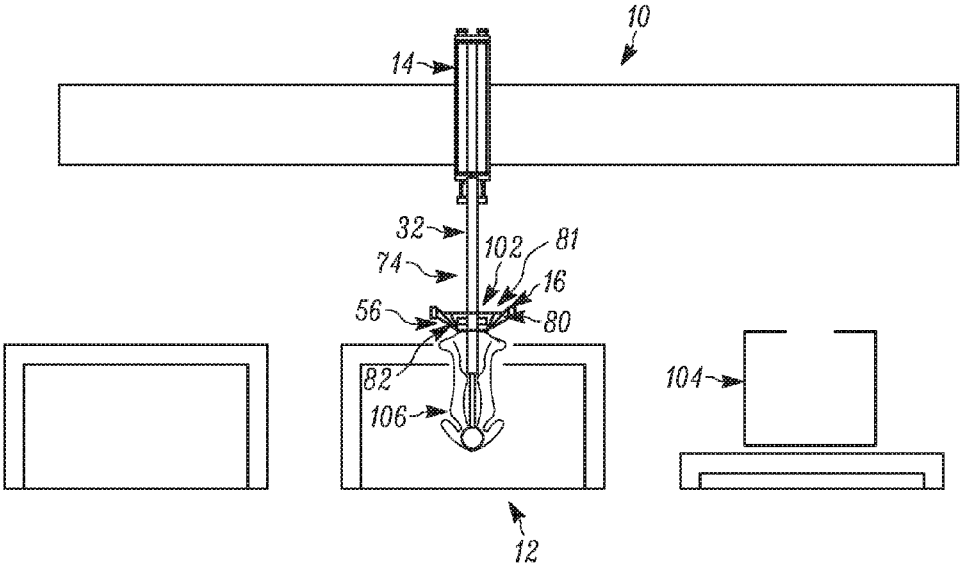

With reference to FIG. 15, continued downward (or insertive) movement into the cavity changes the shape of the bag to an orientation wherein the bag takes the general shape of the probe extending around the terminating member and the lower, central and/or upper shaft thereof. As the probe is biased into the extended or articulated configuration, the bag takes an elongated shape, and extends as far as possible under the outward biasing force. The bag elongates to the general maximum permitted by the bag itself.

The continued movement in the insertive direction eventually places the spout into abutment with the spout coupling of the collar 102. As set forth above, the spout remains outside of the cavity due to the relative sizing of each one. Thus, any further insertive movement eventually engages the spout with the collar, thereby locking the same in operable engagement. Any number of different structures, such as a press fit, a one way engagement, a mating slot and tab, or other structure is contemplated to operably engage the two structures. It will be understood that the collet gripping mechanism may, instead grasp and retain the spout in operable releasable engagement.

While (as well as before and/or after) the collar engages the spout, a vacuum can be pulled within the bag by pulling air through the central openings and central bores of the shafts and the openings in the ball end of the terminating member. This is shown schematically in FIG. 16 by the arrows directed away from the probe. Such withdrawal of air will further collapse the bag toward and into contact with the components of the probe 32, thereby orientating and minimizing the bag configuration therearound. With much of the air withdrawn from the interior volume of the bag, the bag follows the contours of the probe in somewhat of a shape mating configuration.

Figure 16:
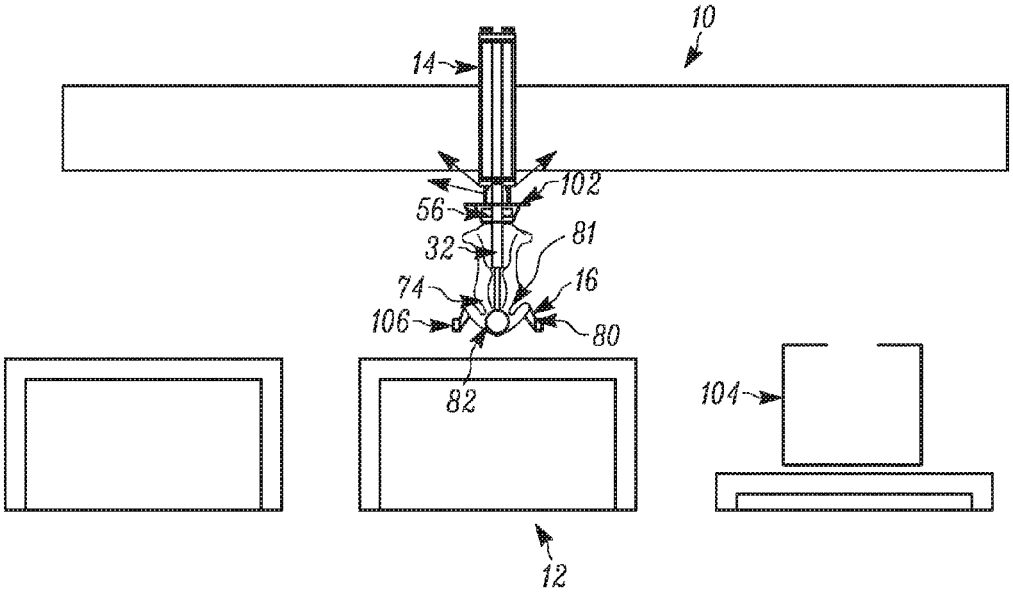

With continued reference to FIG. 16, the probe is then directed in an upward direction relative to the collar mating station 202. The movement first directs the probe and bag back through the opening and into contact with the assembly urging arms 16. The bristles 80 of the assembly urging arms further orient and minimize the bag structure around the probe, by generally directing the bag toward the probe.

Figure 17:
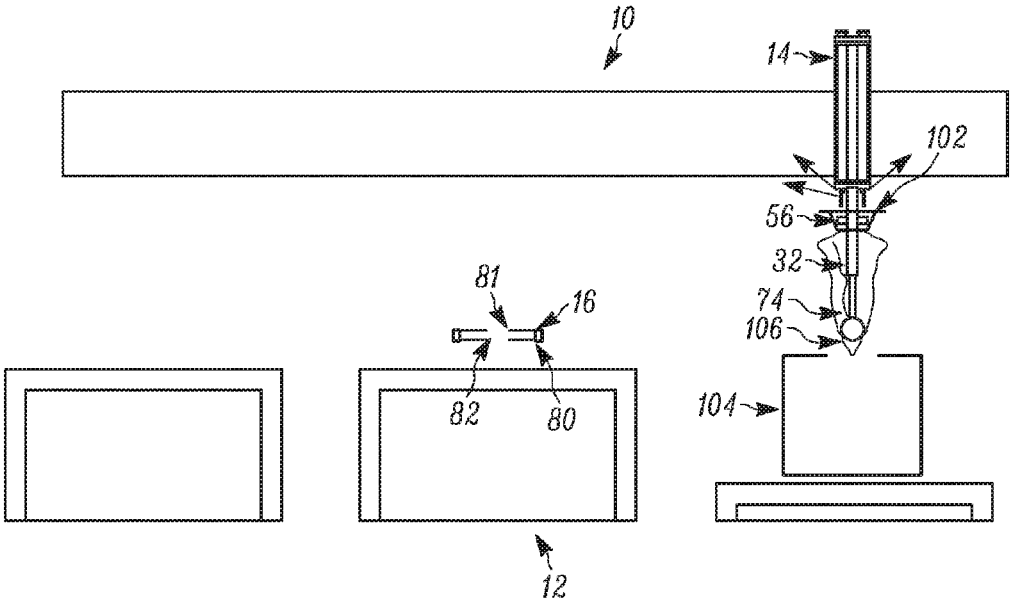

Next, and with reference to FIG. 17, the collar and bag assembly is moved with the probe to a third station. As was explained above, either the insertion assembly can translate relative to portions of the frame to a third station, or a third station may translate to the insertion assembly, or, both may translate to some extent.

Once at the third station, box 104 is positioned on the bag mating station 103 directly below the direction of travel of the probe 32, with the opening positioned in direct orientation relative to the direction of travel of the probe 32. The probe is then extended so as to direct the terminating member into the opening and into the cavity of the box, along with the bag 106 which is wrapped therearound. Interestingly, with the corners of the bag being cut proximate the spout, the configuration of the probe generally eliminates any pinching of the bag that is the result of a portion of the bag remaining outside of the cavity and being sandwiched between the box and the collar. It will be understood that depending on the configuration of the bag and the dimensions of the bag, the angle of the corner seals can be varied, or other changes can be made to the dimensions of the bag. It will be understood that bags other than pillow bags are contemplated for use, however, pillow bags tend to be the most commonly utilize types.

Figure 18:
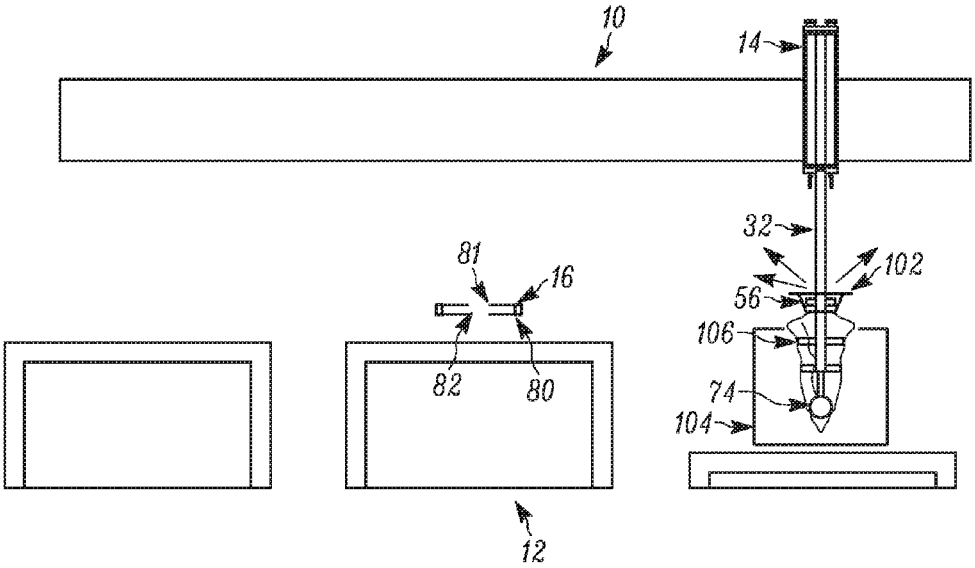
Figure 19:
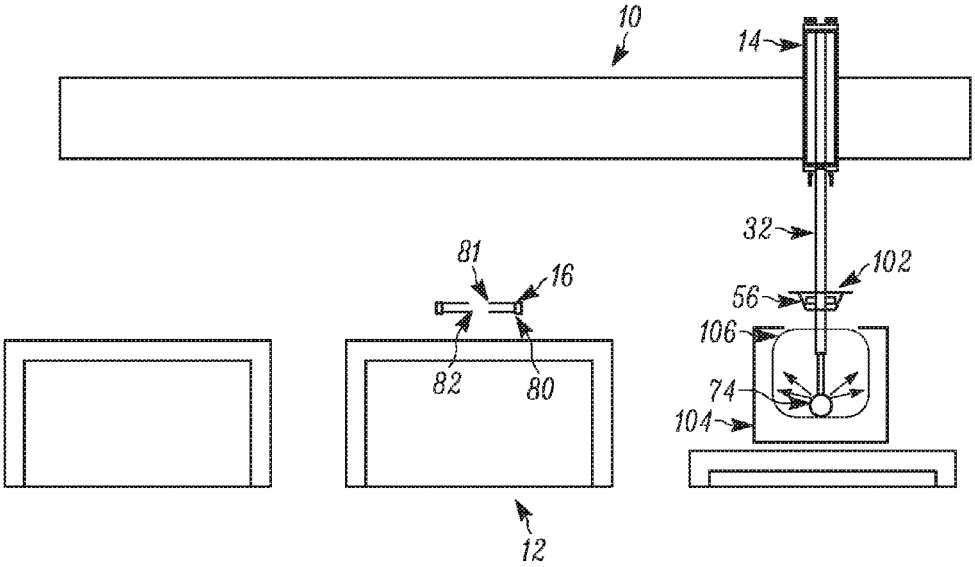

Wit reference to FIGS. 18 and 19, as the bag progresses into the cavity, but preferably prior to the collar 102 engaging the opening, air is directed into the bag through the same openings (or different openings) from which air was previously withdrawn from the bag. The air partially fills the bag, thereby expanding the bag toward and into contact with the box 104. The air that is outside of the bag but within the cavity 108 of the box 104 is forced out through the opening in the process. In other embodiments, other openings may exist around the box to allow the air within the cavity to be expelled by the inflating bag.

Figure 20:
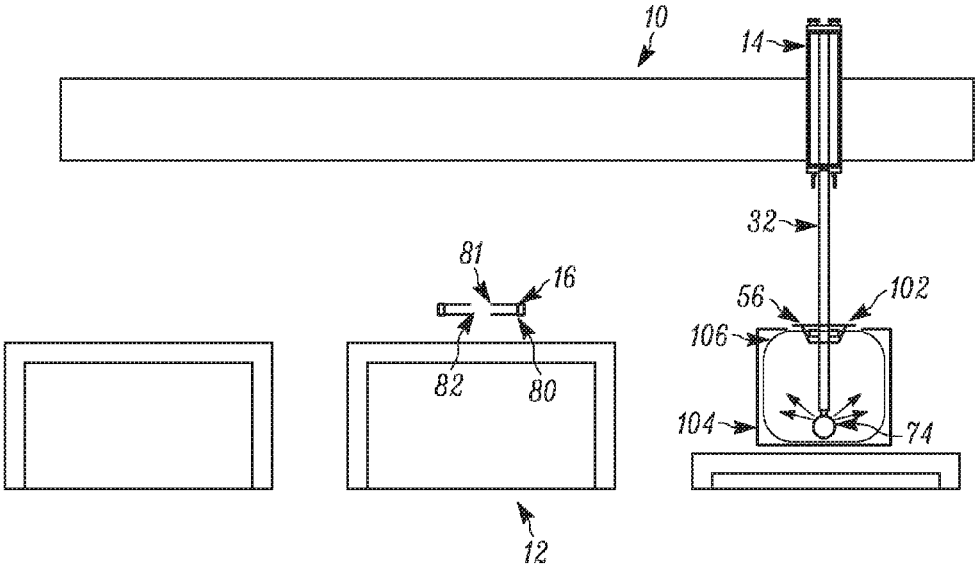

With reference to FIG. 20, at some point, the bag is approaching a filled state, and the air around the bag and within the cavity has been substantially evacuated. At such time, the probe is further inserted and collar is snapped into place about the opening to be coupled thereto. As the shafts are telescoping, and biased relative to each other, it may be the case that the ball end 74 reaches the bottom panel of the box 103 and further movement would then overcome the biasing force of the collapsing springs, thereby effectively reducing the length of the overall probe. As such, the probe does not damage the box or the bag. Additionally, the configuration of the ball end precludes damage, abrasion or other wear on the inner surface of the bag that is sandwiched between the ball end and the bottom panel of the box. Once the collar is coupled to the box, the bag can be fully inflated.

Figure 21:
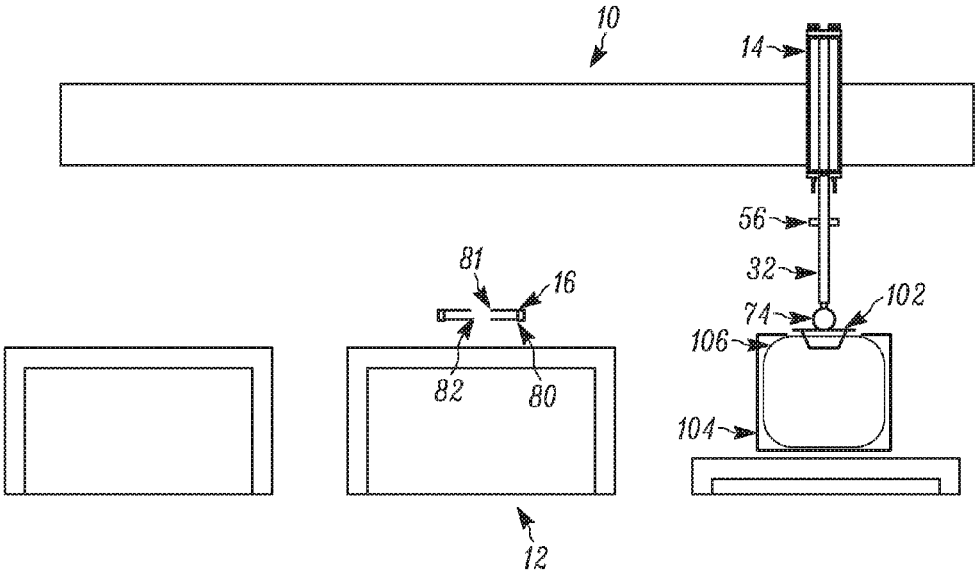

With reference to FIG. 21, after full inflation, or, inflation to the desired amount, the probe 32 is withdrawn from within the cavity of the box 104. The collet gripping mechanism 56 releases the collar 102, freeing the probe from being physically coupled to the bag or the collar. Thus, as the probe is removed, the collar remains coupled to the bag, and the bag remains substantially inflated and shape matching to the cavity of the box 104. The bag can then be filled on downstream, or separate, filling equipment.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A method of coupling a bag to a box for a bag-in-box package comprising the steps of:

providing a box having a plurality of panels defining a cavity, and an opening providing ingress into the cavity;

providing a bag having a plurality of panels heat sealed together to form a substantially fluid-tight cavity with a spout coupled thereto providing ingress into the cavity;

providing a collar that includes an opening configured to accept and retain the spout in engagement;

providing an insertion assembly having a probe terminating at a distal end;

extending the probe into the opening of the collar;

retaining the collar in engagement with the probe in an orientation that is spaced apart from the distal end thereof;

inserting the probe into the fluid-tight cavity of the bag while substantially retaining the spout coupling the collar to the spout through continued insertion of the distal end of the probe into the substantially fluid-tight cavity of the bag;

extending the distal end of the probe into the bag through the spout, while substantially retaining the spout so as to elongate the bag along the probe;

inserting the probe with the bag extended therearound into the cavity of the box; and removing the probe from within the cavity of the box while maintaining the bag within the box.

2. The method of claim 1 further comprising the step of:

evacuating air from within the bag to orient the bag in shape mating form with the probe prior to the step of inserting the probe into the cavity of the box.

3. The method of claim 1 further comprising the step of:

attaching the collar to the opening of the box prior to the step of removing the probe from within the cavity of the box.

4. The method of claim 3 further comprising the step of:

configuring the bag to preclude pinching of a portion of the bag between the collar and the box prior to the step of attaching.

5. The method of claim 3 further comprising the step of:

inflating the bag after the step of inserting the probe into the cavity of the box but prior to the step of attaching the collar.

6. The method of claim 1 further comprising the step of:

inflating the bag after the step of inserting the probe into the cavity of the box.

7. The method of claim 1 wherein the probe has a length that can vary with the configuration of the bag.

8. The method of claim 7 wherein the probe includes telescoping components that are outwardly biased relative to each other toward an increasing length.

9. The method of claim 1 wherein the bag comprises a pillow bag.

10. The method of claim 1 wherein the step of: extending the distal end of the probe into the bag through the spout, while substantially retaining the spout so as to elongate the bag along the probe further comprises the steps of:

providing assembly urging arms; and directing the bag against the assembly urging arms whereby the assembly urging arms direct the bag inwardly toward the probe.

11. The method of claim 1 further comprising the steps of:

providing a collar pickup station;

providing a bag and collar mating station; and providing a collar to box mating station; wherein, the step of retaining the collar in engagement with the probe occurs at the collar pickup station, the step of coupling the collar to the spout occurs at the bag and collar mating station and the step of inserting the probe with the bag extended therearound into the cavity of the box occurs at the collar to box mating station.

12. The method of claim 11 wherein the probe is configured to translate between the collar pickup station, the bag and collar mating station and the collar to box mating station.

13. The method of claim 1 further comprising the step of:

configuring the bag to preclude pinching of a portion of the bag between the collar and the box prior to the step of removing the probe from within the cavity of the box.

* * * * *